United States Patent [19]

Pierce

[11] Patent Number: 4,850,863

[45] Date of Patent: Jul. 25, 1989

[54] SEALED INSULATING WALL FOR A FURNACE

[75] Inventor: Clifford R. Pierce, Perkasie, Pa.

[73] Assignee: Vacuum Furnaces System Corporation, Souderton, Pa.

[21] Appl. No.: 194,161

[22] Filed: May 16, 1988

[51] Int. Cl.[4] ..... F27D 23/00; F27B 3/14

[52] U.S. Cl. ..... 432/206; 432/248; 432/249; 110/336

[58] Field of Search ..... 432/247, 248, 249, 250, 432/237, 242, 206; 110/336

[56] References Cited

U.S. PATENT DOCUMENTS

| | | | |
|---|---|---|---|
| 3,598,378 | 8/1971 | Lundstrom | 432/249 |
| 3,940,245 | 2/1976 | Smith, Jr. et al. | 432/249 |
| 4,013,394 | 3/1977 | Witkin et al. | 432/249 |
| 4,039,280 | 8/1977 | Kienow et al. | 432/248 |
| 4,151,400 | 4/1979 | Smith, Jr. et al. | 432/206 |

*Primary Examiner*—Henry C. Yuen

*Attorney, Agent, or Firm*—William E. Cleaver

[57] ABSTRACT

The present device comprises an enclosing structure for a vacuum furnace hot zone. The enclosing structure, in a preferred embodiment, includes an outside wall (usually fabricated from stainless steel), and inside wall (usually fabricated from laminated graphite sheets) and layers of graphite felt located between the outside wall and the inside wall. The graphite felt is "cut back" so as to be shorter than both the outside wall and the inside wall, thereby creating a channel around the end of the enclosing structure. The present device further includes insert structure inserted into the channel and the insert structure comprises a backing of heat insulating rigidized material as well as a bonded front strip, in a preferred embodiment, fabricated from laminated graphite sheets. The insert seals and prevents any particles, emanating from the layers of loose fibered blanket of insulating material, from entering the hot zone, or other sections of the furnace, to contaminate the same.

2 Claims, 1 Drawing Sheet

SEALED INSULATING WALL FOR A FURNACE

BACKGROUND OF THE DISCLOSURE

It is common practice in the vacuum furnace industry to have a hot zone which has an enveloping structure. The enveloping structure is in fact an insulation package. The enveloping structure is very often cylindrical in shape with a cavity formed therewithin. Within the cavity the work pieces (which are going to be heat treated) are located. The enveloping structure comprises an outside wall and an inside wall with the inside wall being separted from the outside by a space. Within the separation there are located multilayers of graphite felt. I have found that the multilayers of insulation tend to "break up" after repeated cycles of hot and cold temperatures. The consequence of the "breaking up" of the insulation material has been to have particles of the insulation material pass from the ends of the insulation layers into the hot zone (or other sections of the furnace) and contaminate work pieces or contaminate sections of the furnace. The present device prevents such contamination.

SUMMARY OF THE DISCLOSURE

The present structure includes designing the walls of a hot zone so that between the outside wall (which is fabricated of stainless steel in the preferred embodiment), and the inside wall (which is fabricated of laminated graphite sheets in a preferred embodiment) there are located many layers of graphite felt. In the present device, the ends of the graphite felt, which heretofore have been formed to be even with the outside wall and the inside wall, are "cut back". Accordingly a channel is formed within the insulation package. The insulation layers per se constitute the base of the channel while sections of the outside wall and the inside wall (which protrude beyond the "cut back" edge of the insulation), become the channel walls. Into the channel there is located an insert device. The insert device is made up of principally of two parts. One part of the insert is fabricated from rigidized heat insulating material and the other part is a strip of laminated graphite sheets bonded to the first part. The insert is placed in the channel with the strip of the laminated graphite sheets providing the edge of the enveloping structure, or the outside surface of the enveloping structure, between the outside wall and the inside wall. The insert device serves to block any material from leaving the ends of the insulation layers. The laminated graphite sheets strip provides a continuity of the inside wall to both edges of the enveloping structure (i.e., three sides of the enveloping structure are fabricated from the laminated graphite sheets) to provide a seal.

The objects and features of the present invention will be better understood in view of the following description taken in conjunction with the drawings: wherein FIG. 1 is a pictorial of a hot zone;

Figure 1:
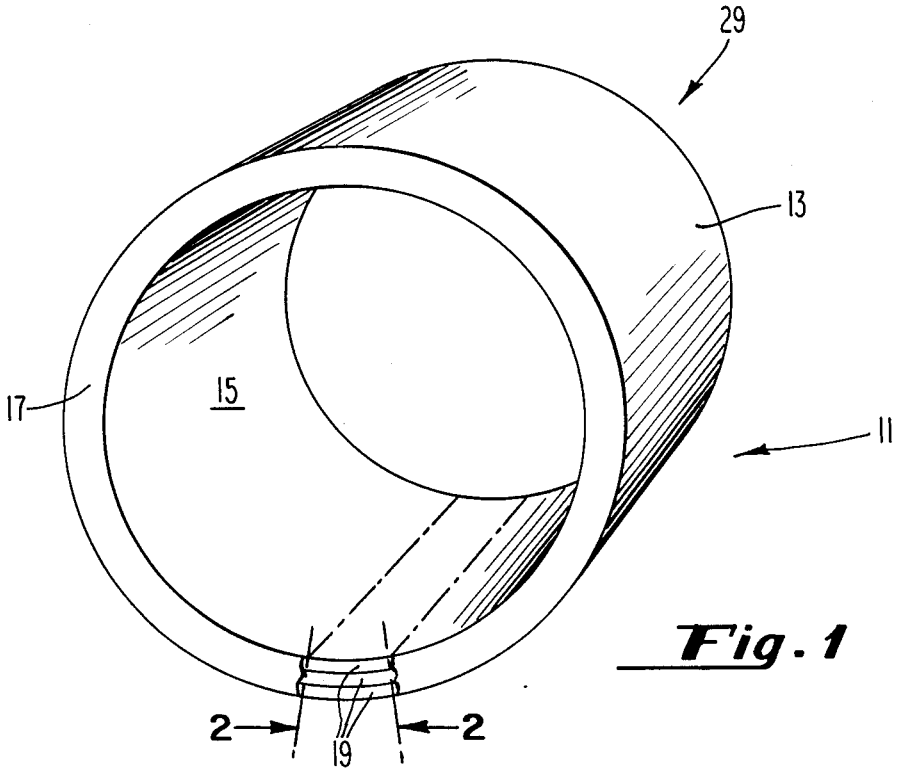

Consider FIG. 1. In FIG. 1 there is depicted a hot zone 11. The hot zone 11 is made up of an outside wall 13 as well as an inside wall 15. In a preferred embodiment the outside wall 13 is fabricated from stainless steel although other suitable materials could be used. The inside wall 15, in the preferred embodiment, is fabricated from laminated graphite sheets and the commercial Grafoil (trademark of Union Carbide Co.) is often employed. It should be understood that other suitable materials could be used. In FIG. 1 the ends of the hot zone 11 are shown sealed by a strip 17. In FIG. 1, the strip 17 is shown broken away to show three insulation material layers 19. The three insulation layers 19 are fabricated from graphite felt. It should be noted in FIG. 1 that the graphite felt is shown coming to the edge of the inside wall 15 as well as the edge of the outside wall 13. Such an arrangement is the arrangement of the prior art, although the prior art does not have the strip 17 secured thereto as shown in FIG. 1. In other words in the prior art the heat insulation multilayers 19 are concentric and are arranged to fit between the edges of the outside wall 13 and the inside wall 15.

Figure 2:
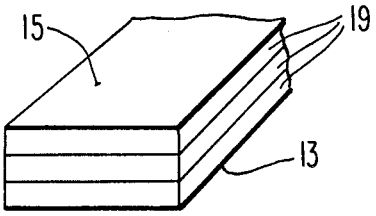
FIG. 2 is a slide of the hot zone shown without the insulation material "cut back"

In FIG. 2 there is shown a slice 2—2 or a portion of a slice 2—2 taken through FIG. 1. In FIG. 2 the outside wall 13 and the inside wall 15 are depicted as are the heat insulation layers 19. It should be noted in FIG. 2 that the heat insulation layers 19 come out to the edge of the outside wall 13 as well as the edge of the inside wall 15. What is done to accomplish one of the objects of the present invention, is to "cut away" the layers 19 to provide a channel, such as channel 21, shown in FIG. 3.

Figure 3:
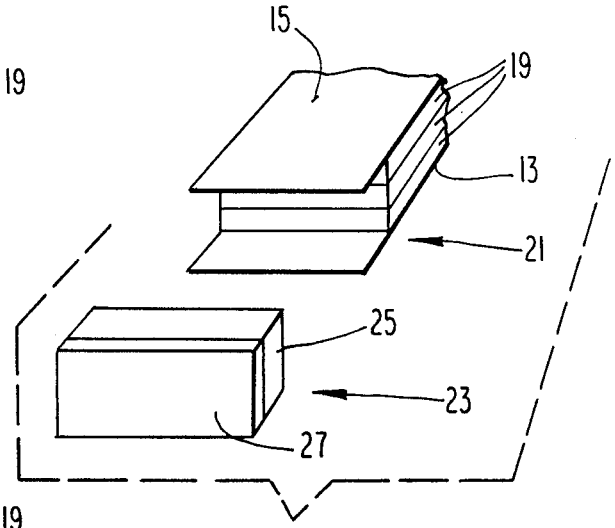
FIG. 3 depicts the slice shown in FIG. 2 with the insulating material "cut back" and the insert located for insertion into a channel.

In FIG. 3 there is shown the outside wall 13 and the inside wall 15 as well as the multilayered insulation 19. However, note that the multilayered insulation 19 is cut back, or removed, so that there is a channel 21 formed. The channel 21 is formed by having the edge of multilayered insulation 19 become the base thereof, while portions of the outside wall 13 and the inside wall 15 form the walls of the channel. Note further in FIG. 3 that there is an insert device 23. The insert device 23 is made up of two parts. The first part of the insert 23 comprises the insulation material 25 and the second part comprises the strip 27. The first part, or insulation 25, is fabricated from rigidized graphite felt and note that,it is a solid block as shown while the strip 27 is fabricated from Grafoil and bonded to one face of insulation block 25. In other words the same material as made up the inside wall 15 is used to fabricate the strip 27. When the insert 23 is inserted into the channel 21, the structure looks as the structure shown in FIG. 4.

Figure 4:
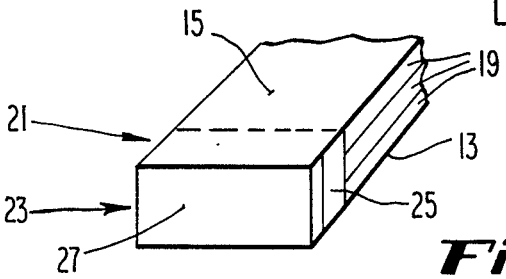
FIG. 4 depicts the insert inserted into the channel to seal off the ends of the insulation material.

In FIG. 4 there is shown the end of the hot zone with the insert 23 disposed within the channel 21. As can be seen in FIG. 4, the inside wall 15 and the outside wall 13 extend beyond the ends of the insulation layers 19. As can be further seen in FIG. 4 the insert 23 is formed, dimension wise, to fit within the channel 21 so that the bottom of the insert abuts against the ends of the layers 19.

If once again we examine FIG. 1 and we assume that the strip 17 is really the strip 27 and that behind the strip 17 there is a section of insulation material, similar to the section of insulation material 25 and that those materials represent an insert, then the end of the hot zone 11 will appear as the strip 17. Therefore the end of the hot zone will be sealed so that the insulation material 19 will not "break away" and move out into the furnace and therefore into the hot zone to contaminate the work pieces. It should be understood that there will be a similar arrangement at the other end 29 of the hot zone 11. Accordingly both ends of the hot zone are sealed and the presence of contaminants in the hot zone is greatly reduced.

I claim:

1. A multilayered wall to be used as part of a hot zone means in a furnace means comprising in combination:

outside wall member means formed cylindrically so as to define a first cavity, with a length dimension;

inside wall member means formed cylindrically so as to define a second cavity, with a length dimension, said inside wall member means further formed to have such dimensions that said inside wall member means fits within said first cavity, said inside wall member means further formed and disposed to define a separation between said inside wall member means and said outside wall member means;

heat insulation means having first and second ends disposed in said separation between said inside wall member means and said outside wall member means, said heat insulation means formed to be shorter in length than respectively either said inside wall member means and said outside wall member means so that first channel means is formed by said first end of said heat insulation means and a portion of said inside wall member means and a portion of said outside wall member means; and sealing insert means formed to fit in said first channel means and formed to seal said heat insulation means whereby said heat insulation means is sealed from passing particles thereof from its first end into other areas of said furnace, said sealing insert means being made up of two parts with one part being heat insulating means and the other part being a strip of laminated graphite sheets bonded to said one part.

2. A multilayered wall according to claim 1 wherein said one part is fabricated of rigidized heat insulating material and wherein when said sealing insert means when disposed in said first channel said other part becomes an outside edge wall lying between said outside wall member means and said inside wall member means.

* * * * *